US009492004B1

(12) United States Patent
Young

(10) Patent No.: US 9,492,004 B1
(45) Date of Patent: Nov. 15, 2016

(54) LIGHTWEIGHT SUSPENSION HARNESS SYSTEM FOR BINOCULARS AND METHOD OF USE

(71) Applicant: Rick Young, Boring, OR (US)

(72) Inventor: Rick Young, Boring, OR (US)

( * ) Notice: Subject to any disclaimer, the term of this patent is extended or adjusted under 35 U.S.C. 154(b) by 0 days.

(21) Appl. No.: 15/130,927

(22) Filed: Apr. 15, 2016

Related U.S. Application Data

(60) Provisional application No. 62/207,836, filed on Aug. 20, 2015.

(51) Int. Cl.
*A45F 5/00* (2006.01)
*A45F 3/14* (2006.01)

(52) U.S. Cl.
CPC . *A45F 5/00* (2013.01); *A45F 3/14* (2013.01); *A45F 2005/006* (2013.01); *Y10S 224/909* (2013.01)

(58) Field of Classification Search
CPC ..... A45F 5/00; A45F 2003/142; A45F 2005/006; A45C 11/08; Y10S 224/908; Y10S 224/909
USPC ..... 224/257, 258, 908, 909
See application file for complete search history.

(56) References Cited

U.S. PATENT DOCUMENTS

| | | | | | |
|---|---|---|---|---|---|
| 1,586,251 | A * | 5/1926 | Lang | G10G 5/005 | 224/258 |
| 2,273,136 | A * | 2/1942 | Orech | F16G 11/14 | 224/258 |
| 3,326,430 | A * | 6/1967 | Banks | A45F 5/00 | 224/254 |
| 3,526,347 | A * | 9/1970 | Kuban | A45F 5/00 | 224/259 |
| 3,884,403 | A * | 5/1975 | Brewer | A45F 3/14 | 224/257 |
| 4,349,139 | A * | 9/1982 | Oishi | A45F 5/00 | 224/257 |
| 4,898,311 | A * | 2/1990 | Boyer | A45F 5/00 | 224/257 |
| 5,016,797 | A * | 5/1991 | Rowledge | A45F 5/00 | 224/257 |
| 6,983,870 | B2 * | 1/2006 | Hancock | A45F 3/14 | 224/258 |

* cited by examiner

*Primary Examiner* — Justin Larson
(74) *Attorney, Agent, or Firm* — J. Todd Rushton

(57) ABSTRACT

The present disclosure relates to a lightweight harness system that may be used to secure binoculars, cameras, and similar devices. The harness comprising a single strand of elastic cordage and fit for the harness may be altered using a single adjuster clip.

9 Claims, 6 Drawing Sheets

LIGHTWEIGHT SUSPENSION HARNESS SYSTEM FOR BINOCULARS AND METHOD OF USE

The present application claims priority under 35 USC §119(e) to U.S. Provisional Application 62/207,836 for LIGHTWEIGHT HARNESS SYSTEM FOR SECURING BINOCULARS, CAMERAS AND SIMILAR DEVICES, filed Aug. 20, 2015. The disclosure therein incorporated by reference.

BACKGROUND

Conventional harnesses for securing binoculars, cameras, and similar devices may include heavy-duty straps and/or buckles that are bulky, restrict motion, trap body heat, dig into a body of a user, and/or cause friction on the skin of a user. Accordingly, conventional harnesses may be uncomfortable to wear, particularly for extended periods of time and/or while engaging in activities that require body motion, such as walking, biking, hiking, etc. Conventional harnesses may also be designed to be worn comfortably only one way, such as, a shoulder harnesses having heavy straps will present extra non-supporting straps on the users chest if the user attempts to wear the harness as a simple neck strap or loop. Additionally, sizing and/or fitting a conventional harness to a user may require adjustments on multiple points on the harness, such as on a chest strap, back strap, shoulder strap, waist strap, etc. Accordingly, conventional harnesses may be inconvenient to use, particularly in situations which require size and/or fit adjustments for each use, such as when two or more users share the use of a single conventional harness at different times.

Therefore, for the above-mentioned reasons, there is a need for easily adjustable, lightweight harnesses having cords that do not restrict motion, trap body heat, dig into a body of a user, cause friction on skin of a user and may be worn comfortably in multiple configurations.

SUMMARY OF THE INVENTION

A first embodiment of the present invention or, lightweight suspension harness system includes a single length of high quality elastic cordage, a plunger type cord-lock length adjuster clip and attachment hardware or fasteners. The length of elastic cordage formed into a continuous loop wherein, the cordage is fixedly attached to an attachment point on the adjuster clip proximate the mid-point of the cordage with fasteners moveably positioned over the free ends of the cordage, the free ends of the cordage are then brought together and reversed back through a plunger lock aperture of the adjuster clip where the free ends of the cordage are attached together. In one embodiment this may be a simple overhand knot, surgeon's knot or other suitable knot; the cordage may also be sewn or otherwise bound together. In other embodiments the free ends of the cordage may be secured together using a mechanical crimp or locking sleeve. In yet another embodiment the mechanical lock may include a safety whistle or compass. The effect of the cordage arrangement will be to form two independent loops of cordage, each loop having a freely moveable fastener or attachment hardware captured on the cordage within the loop, and the free ends extending through an aperture on the adjuster clip. When the cordage free ends are pulled through the adjuster clip each of the cordage loops will be reduced in size, if the adjuster clip is released, and the user pulls on the cordage loops, the length of cordage within the loops will be increased. One important element of the present invention is that when that when cordage is moved through the adjuster clip the entire harnesses adjusts proportionally and creates balance in the harness system.

The fasteners of the first embodiment of the present invention may be securely attached to a pair of binoculars using hardware or drilled attachment studs which are typically positioned on the binocular lens barrels below the eye piece and in a position wherein, when the weight of the binoculars is unsupported, the lens barrels will align vertically with the objective lenses facing downward and the eye pieces pointing up toward the users face.

The first embodiment of the present invention may worn or positioned on a user in several configurations, including but not limited to; worn as a simple strap or neck strap, over the shoulder bandolier position, arm through the loop over the shoulder position, a simple harness position and a restrained harness or "overwrap lockdown" position.

The simple strap or simple neck strap is wherein the user places the adjuster clip, over the head and behind the neck, with two strands (each a part of the continuous strand) of cordage extending over each shoulder and down to the fastener attached to the binoculars hanging in front on the chest of the user.

The over the shoulder position or "side saddle" is achieved when the user places the adjuster clip over the head and on top of the shoulder on a desired side and the arm on the opposite side is extended through a loop formed between each of the system fastener loops. Again there will be two stands of cordage extending essentially parallel to each other from the fastener on the binoculars to the adjuster clip. The binocular will hang against the side of the user under the arm opposite the adjuster clip.

The next position or "side pull" is achieve by placing the adjuster clip over the head and behind the top of the shoulder on the desired side, the arm on the same side is extended through the fastener loop toward the front of the user and the opposite arm is extend through the loop formed between the two fastener loops. In this configuration the fastener loop in front of the user will have one stand of cordage extending over the user's shoulder and across the chest with the second strand extending from under the arm and across the upper abdomen to the binoculars. The second fastener loop on the back of the user will have parallel cordage strands running diagonally down the back from the adjuster clip to the binocular fastener. Again the binoculars will hang at the user's side, opposite the adjuster clip, but will be further constrained from rotating around the user's body.

In the standard harness carry configuration the user, the user, with the binoculars in front, extends both arms through the corresponding fastener loops and places the adjuster clip over the head and behind the neck. The binoculars will hang at the user's chest with one strand from the fastener loop extending up over the shoulder and the second strand extending under the user's arm to the fastener clip. The height and position of the binoculars can be adjusted by pulling cordage through the adjuster clip, if more cordage is pulled to the users back, the binoculars will ride high on the user's chest, if the cordage is released, the binoculars will be carried lower on the abdomen. Adjustments are accomplished by simply pulling on the cordage strands that extend through the adjuster clip, the fasteners on each cordage loop will slide on the cordage and automatically equalize the tension in the harness system.

The restrained or "overwrap lockdown" harness position is accomplish in the same method as the standard harness configuration except the upper strand of the fastener loop is extended over the objective lens of the binoculars on each side. This configuration rapidly removes slack from the harness system and the elasticity in the system comfortably secures the full binocular body against the chest of the user. This configuration may be desirable when the user needs to silence noise when moving, or anticipates sudden unexpected movements, such as, when travelling by horseback, all-terrain vehicle, or when hiking or climbing in difficult terrain.

Embodiments of the lightweight harness system according to aspects of the present teachings may include an easily-adjustable, elastic harness configured to detachably secure a device, such as a camera, rangefinder, or binoculars; a device retention cord configured to detachably secure a secondary device to the harness; a lens cap retention cord configured to detachably secure a lens cap to an attachment ring of the harness; and/or a collapsible covering configured to protect the device(s) when the covering is expanded. Additionally, in some embodiments, such as when the device(s) may not have an engagement portion compatible for direct attachment to the harness, an attachment adapter may be used to detachably secure device(s) to the harness.

DETAILED DESCRIPTION OF THE DRAWINGS

Overview of Harness Systems

Various embodiments of harness systems for securing binoculars, cameras, and similar devices are described below and illustrated in the associated drawings. The following description of various embodiments is merely illustrative in nature and is in no way intended to limit the disclosure, its application, or uses. Furthermore, each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Additionally, ordinal indicators, such as first or second, for identified elements are used to distinguish between the elements, and do not indicate a required or limited number of such elements, and do not indicate a particular position or order of such elements unless otherwise specifically stated.

1. General Features

This section describes general features of a harness system according to aspects of the present teachings; see FIGS. 1-4B, or harness for binoculars, cameras, and similar devices such as rangefinders, mobile phones, light meters, etc. Embodiments of the harness may be lightweight and elastic, thus not restricting motion and being comfortable for a user to wear. Specifically, when worn around shoulders and chest of a user, the harness may grip the shoulders of a user and transfer weight of the harness equally around the shoulders and chest of the user without uncomfortably digging into the shoulders and/or chest of the user, and/or without causing uncomfortable friction when the user moves around. Further, due to being lightweight, the harness may not trap body heat or cause perspiration. Accordingly, the harness may be ideal for extended and/or active wear. Additionally, the harness may be easily adjustable from a single point on the harness.

Figure 1A:
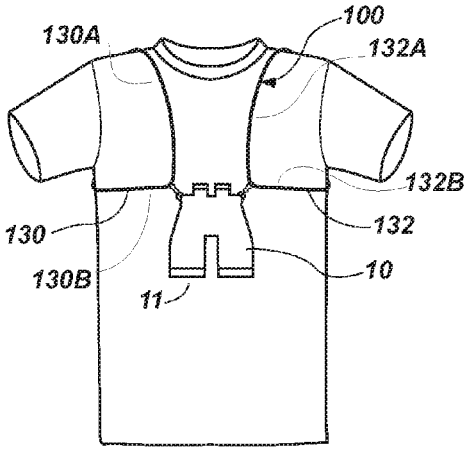
FIGS. 1A-1E is sketches showing positions in which a user may wear the harness, according to aspects of the present teachings.
Figure 1B:
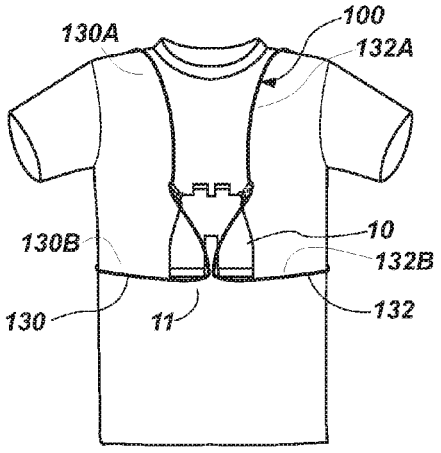
Figure 1C:
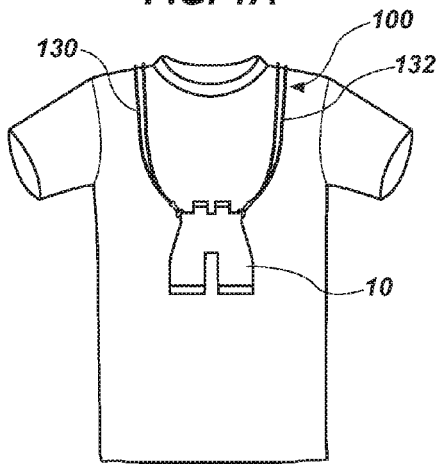
Figure 1D:
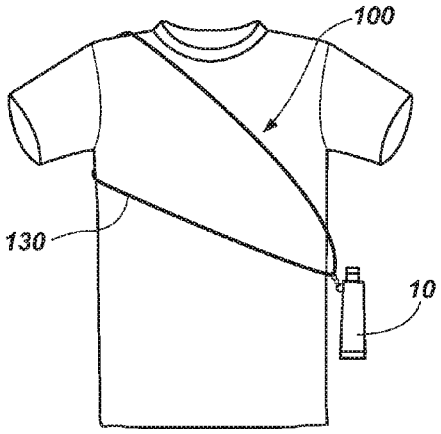
Figure 1E:
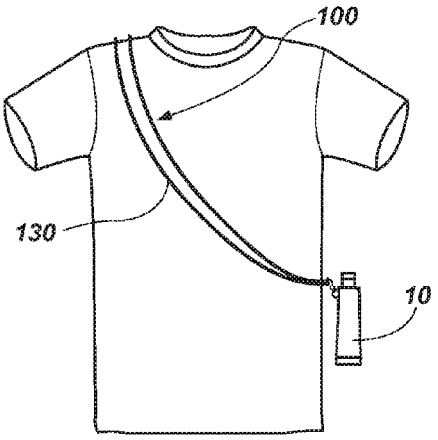

FIGS. 1A-1E illustrate ways in which a user may wear the harness 100. Specifically, as shown in FIG. 1A, a user may wear the harness 100 in a traditional configuration, i.e., with a first arm in a first loop 130 of the harness and a second arm in a second loop 132 of the harness, and wherein a device secured to the harness, such as binoculars 10, rest adjacent to a chest of the user. Alternatively, as shown in FIG. 1B, the user may wear the harness 100 in an restrained position or "overwrap lockdown" configuration, which is similar to the traditional configuration; however, lower portions of the first loop 130 and second loop 132 may be pulled over the objective lens 11 of the binoculars 10 to remove any slack from the harness system and restrain the binoculars against the user's chest. In another alternative, as shown in FIG. 1C, the user may wear the harness 100 as a neck strap, i.e., without placing arms of the user into loops of the harness 100, and wherein the binoculars rest adjacent to the chest of the user. In yet another alternative, as shown in FIG. 1D, the user may wear the harness 100 in a "side pull" configuration, i.e., with a first arm in a first loop 130 of the harness 100, and wherein the binoculars rest adjacent to a side of the user. Alternatively, as shown in FIG. 1E, the user may wear the harness 100 in a "side saddle" position, which is similar to the side pull configuration, but with the first loop 130 resting over a shoulder of the user. However, harness 100 may be worn in any suitable configuration.

Figure 2A:
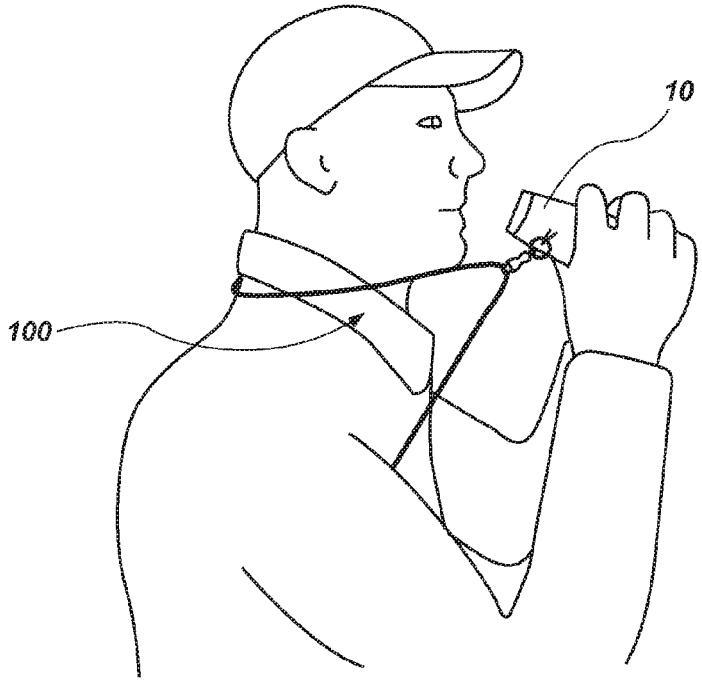
FIGS. 2A-2B is pictures showing the harness in use to secure binoculars, according to aspects of the present teachings.
Figure 2B:
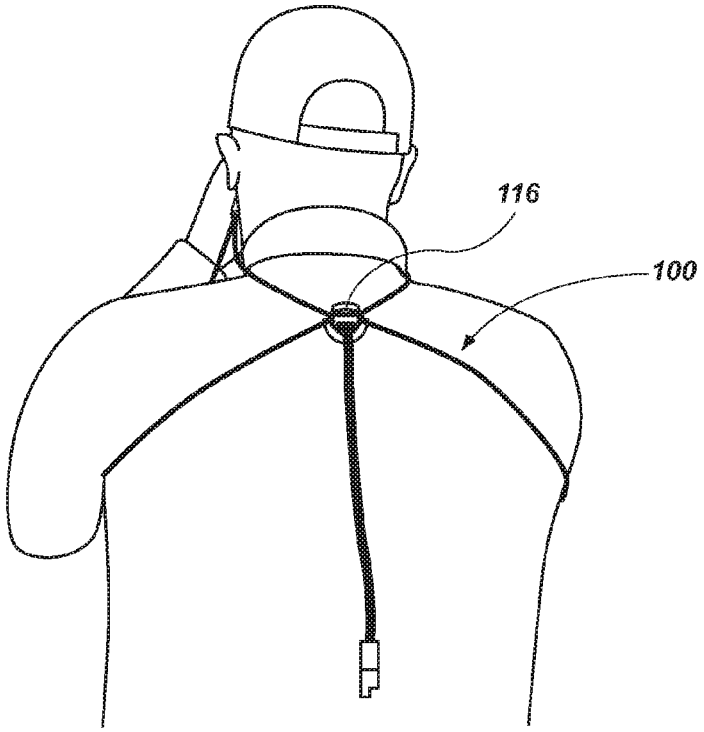

As shown in FIGS. 2A and 2B the harness 100 may be used to secure binoculars 10 for various applications, such as wildlife watching. Specifically, the harness 100 may be worn such that the binoculars 10 rest adjacent to the chest of a user, and such that the user may easily access the binoculars 10. Additionally, the harness 100 may be adjustable to fit any user by using a single point adjustor clip 116 on the harness 100. The position of the binoculars 10 may also be adjustable on the harness 100 using the adjustor clip 116 so that the binoculars may be brought up to a desired height when lifted toward eyes of a user.

2. Harness System Components

This section describes features of an example of a harness 100 according to aspects of the present teachings; see FIGS. 3A-4B.

Figure 3A:
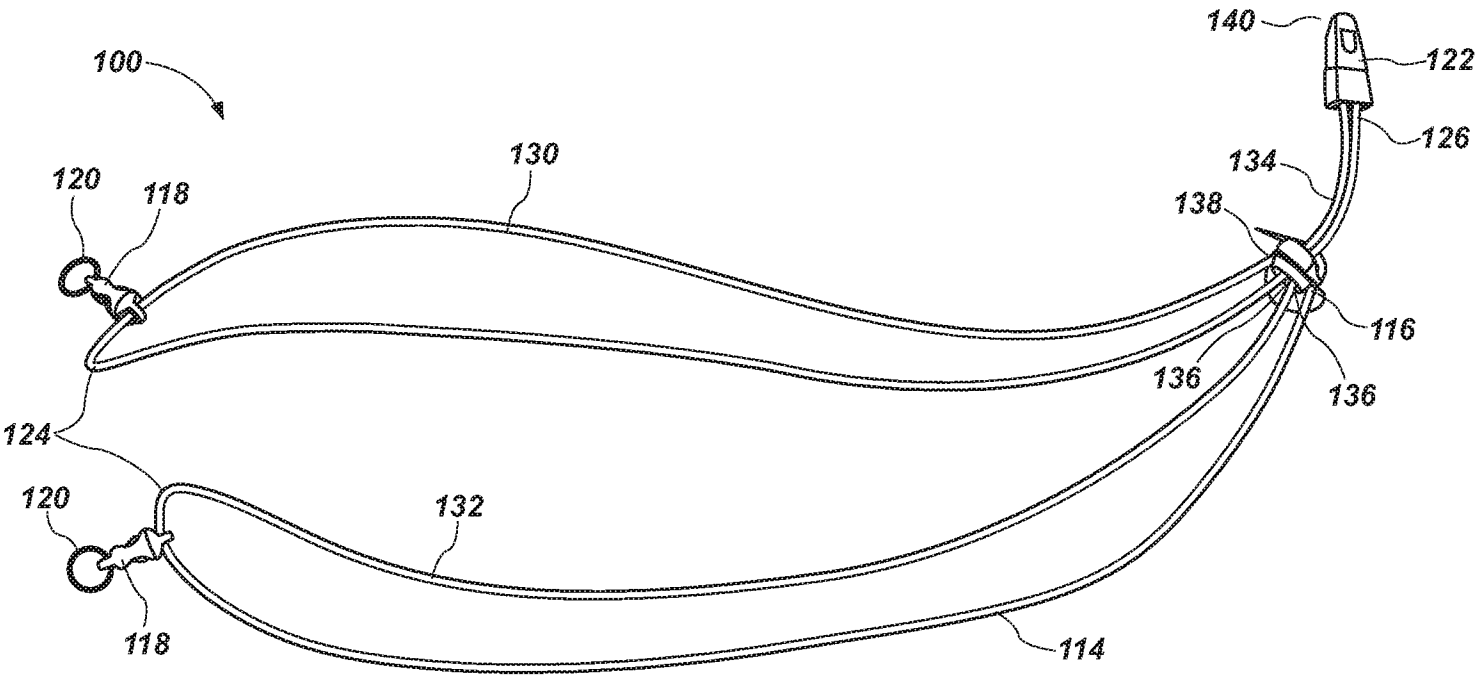
FIG. 3A is a picture showing the harness, according to aspects of the present teachings.
Figure 3B:
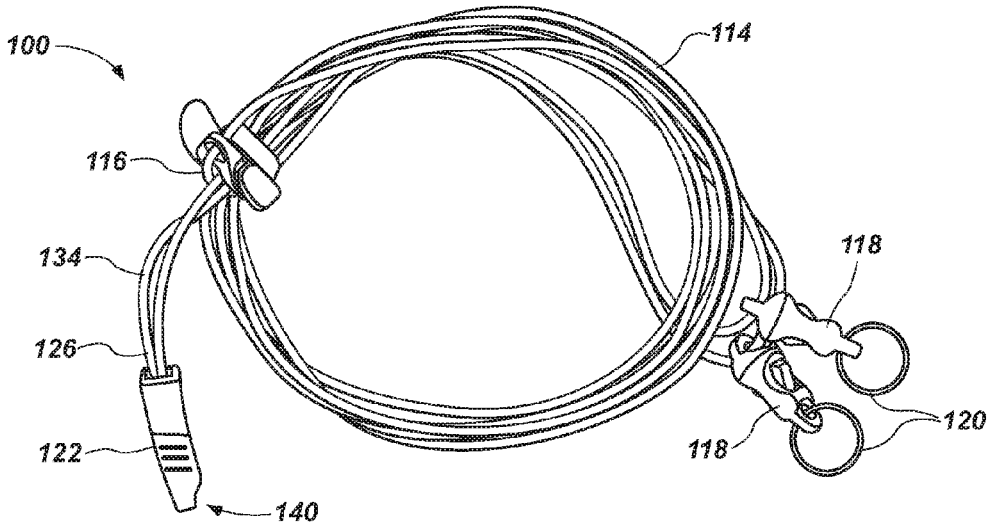
FIG. 3B is a picture showing the harness of FIG. 3A in a coiled position.

As shown in FIGS. 3A-3B, embodiments of the harness 100 may include an elastic cord or cordage 114; an adjustor clip 116; at least one accessory fastener 118 movably attached to the elastic cord 114 within a loop 130 and 132, when cord 114 is under tension, accessory fastener 118 will automatically move to the mid-point 124 of loop 130 and 132. The free ends of cord 114 may be secured using a knot or an end component 122, such as a crimp or mechanical clip. The elastic cord 114 may be adjustable using the adjustor clip 116 and configured to be worn around at least one of a neck, torso, and arm of a user. The elastic cord 114 is a single and/or continuous cord. Further, the elastic cord 114 may be lightweight, sturdy, and capable of retaining elasticity throughout repeated use. For example, the elastic cord 114 may be a shock cord. As shown in FIG. 3B, the elastic cord 114 may be coiled for easy storage or portability without easily being tangled. Additionally, the fastener(s) 118 attached within loops 130 and 132 may be configured to releasably secure the harness 100 to a device (e.g., binoculars, a camera, etc.) having at least one engagement portion. An example of an engagement portion may be a small metal or plastic loop on the device and/or end component 120 may consist of a lightweight composite material or mixture of materials.

Figure 4A:
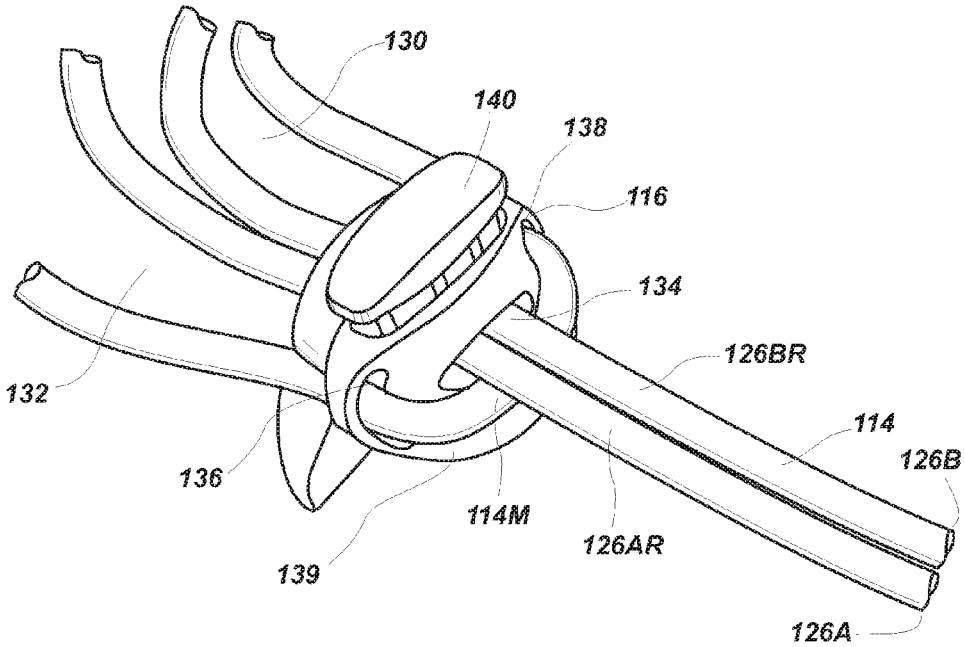
FIG. 4A is a picture showing an example of a single point adjustor clip of the harness according to aspects of the present disclosure.
Figure 4B:
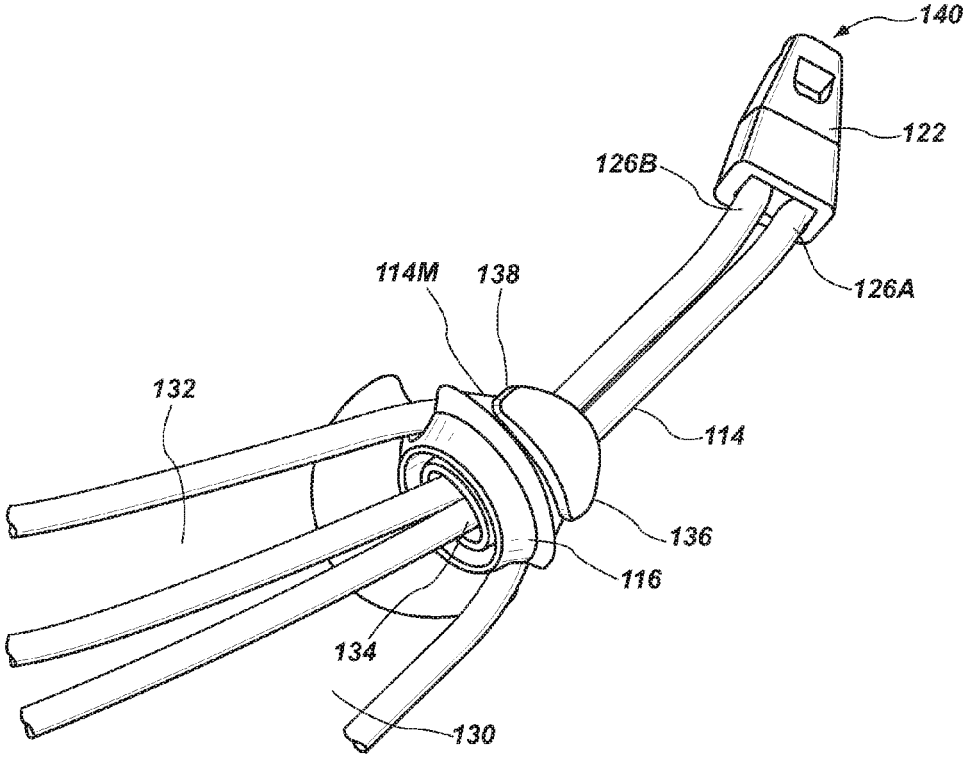
FIG. 4B is another picture showing the adjustor clip of FIG. 4A.

Additionally, as shown in FIGS. 4A-4B, the harness 100 may include a single point adjustor clip 116. A benefit to the harness 100 having a continuous segment of elastic cord 114 and a single adjustor clip 116 is that the size, fit, and/or configuration of the entire harness 100 may be adjusted at a single point on the harness 100. Specifically, in some embodiments, the elastic cord 114 may be a continuous segment that may form a first loop 130 and a second loop 132 by inserting ends 126 of the elastic cord 114 into a single adjustor clip 116. Additionally, a third loop may be formed by inserting ends 126 into an end component 122 having one or more apertures in which the ends 126 may be inserted and secured. Accordingly, the harness 100 may have three loops, the first loop 130, the second loop 132, and the third loop, and the size of each loop may easily be adjusted simultaneously and proportionally by pulling the elastic cord 114 through the adjustor clip 116.

The adjustor clip 116 is shown in more detail in FIGS. 4A-4B. FIG. 4A is a perspective view of the adjustor clip 116 showing a portion of the adjustor clip 116 configured to face substantially toward the ends 126 of the elastic cord. The adjustor clip 116 may include at least one aperture through which the elastic cord 114 may be threaded. For example, as shown in FIG. 4A, the adjustor clip 116 may include three apertures, namely a central first aperture 134, a lateral second aperture 136, and a lateral third aperture 138. The area between apertures 136 and 138 on adjuster clip 116, where the mid-point 114M lays is considered a retention portion 139 of clip 116 configured to fixedly restrain cord 114. Additionally, the adjustor clip 116 may include a securing mechanism. Specifically, the securing mechanism 140 may include an aperture configured to line up with the aperture 134 of the adjustor clip. Accordingly, the ends 126 of the elastic cord 114 may be inserted through both the aperture of the securing mechanism 140 and the aperture 134 of the adjustor clip. Additionally, the securing mechanism 140 may include a spring disposed beneath an upper portion of the securing mechanism 140. A user may press down on the upper portion of the securing mechanism 140 to compress the spring. Accordingly, the securing mechanism 140 may have two effective positions a default first position in which the spring is not compressed by the user, and a second position in which the spring is compressed by the user. In the default position, the spring may create an upward pressure toward the elastic cord 114, thereby squeezing the elastic cord 114 in place on the adjustor clip 116. Conversely, in the compressed position, the spring may be compressed and thus no longer create an upward pressure toward the elastic cord 114 to keep the elastic cord in place in the adjustor clip 116. Accordingly, the harness 100 may be adjusted by pressing down on an upper portion of the securing mechanism 140 of the adjustor clip 116 and pulling the elastic cord 114 through the adjustor clip 116. Further, when the upper portion of the securing mechanism 140 is not pressed down, the securing mechanism 140 may secure the elastic cord 114 in place on the adjustor clip 116.

As illustrated in FIG. 4B, to configure harness 100 elastic cord 114 is threaded through apertures 136 and 138 and is substantially fixedly retained within a retention portion 139 against the adjuster clip 116 at a mid-point 114M of the elastic cord 114. Free ends 126 of cord 114 extend away from adjuster clip 116 and accessory fastener 118 (not shown) is moveably attached over the free ends 126, before the free ends are reversed towards the adjustor clip 116 and inserted through the first central aperture 134. The free ends 126 having a running portion 126AR and 126BR extending away from adjuster clip 116 and the free ends 126A and 126B are then secured together to form a continuous loop within the elastic cord 114. The free ends 126AB may be secured using a knot, binding, sewing, using a crimp fitting or a mechanical clip, such as 122 shown. As configured harness 100 will include the first and second cordage loops 130 and 132 which extend toward the accessory to be suspended on fasteners 118. The first 130 and second 132 cordage loops having an upper portion 130A/132A which when in place, rides over shoulder of the user and a lower portion which is extends ways from the fastener 118 is substantially around the abdomen of the user (see FIGS. 1A and 1B).

In embodiments having an end component 122, the end component may include one or more apertures in which the ends 126 may be inserted and secured. Additionally, the end component 122 may be a built-in feature of the harness 100, or, alternatively, it may be detachable from the harness 100. Further, the end component 122 may be dual-function, i.e., serve a function in addition to securing the ends 126. Specifically, the end component 122 may be a useful device, such as a whistle (shown in FIGS. 3A-4B), compass, etc. Accordingly, the end component 122 may be used not only to secure the ends 126 of the harness 100 but also for safety, communication, navigation, etc. Additionally, the end component 122 may be conveniently accessed by a user (e.g., without requiring the user to dig around in a utility bag to search for the device), without requiring additional items to be clipped to the harness 100.

3. Collapsible Covering

Figure 5A:
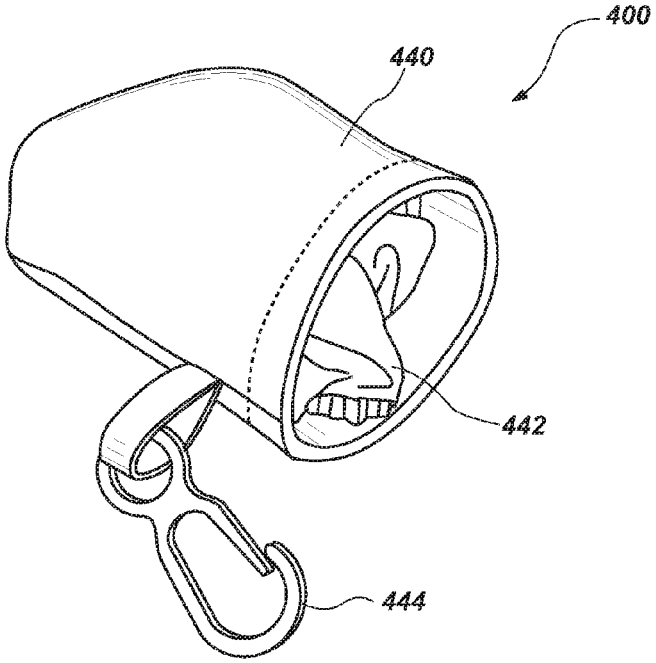
FIG. 5A is a picture showing an example of a collapsible covering in a collapsed position, according to aspects of the present disclosure.
Figure 5B:
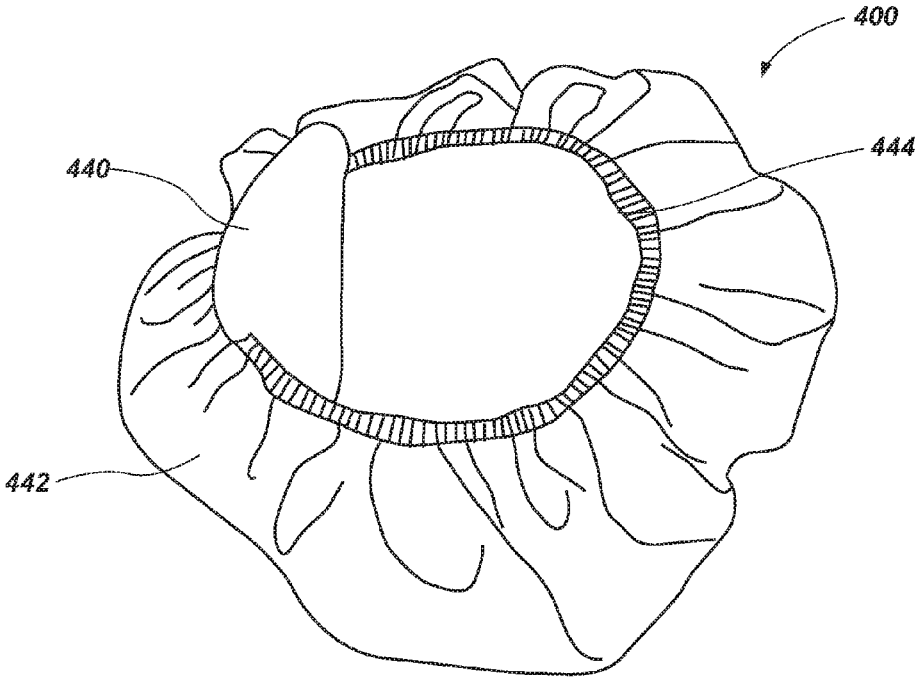
FIG. 5B is a picture showing the collapsible covering of FIG. 5A in an expanded position.

This section describes features of a collapsible covering, according to aspects of the present teachings; see FIGS. 5A-5B.

As shown in FIGS. 5A-5B, the harness system may include a collapsible covering 400, including a pouch portion 440 which is permanently attached to a cover portion 442, and configured to cover and/or protect the device being used with the harness 100. The pouch portion 440 may be of a sturdy, lightweight, and flexible material or mixture of materials. The pouch portion 440 may additionally include an attachment clip 444 for clipping the harness 100 to the harness system when the covering 400 is collapsed and not in use to cover the device. Additionally, the cover portion 442 may be made of a sturdy, lightweight, and flexible material or mixture of materials such as nylon, nonwoven polypropylene, polyester, etc. The cover portion 442 may also be waterproof for additional protection of the device 10.

As shown in FIG. 5A, when not being used to cover the device, the covering 400 may be in a collapsed position. Specifically, the pouch portion 440 may be in a first position, wherein the cover portion 442 may be collapsed and tucked inside of the pouch portion 440. Alternatively, as shown in FIG. 5B, when in use to cover the device, the covering 400 may be in an expanded position. Specifically, the pouch portion 440 may be in a second position that is an inverse of the first position, wherein the cover portion 442 may be expanded and not tucked inside of the pouch 440. The first position may be moved to the second position by removing the cover portion 442 from within the pouch portion 440 and turning the pouch portion 440 substantially inside out. Additionally, as shown in FIG. 5B, the cover portion 442 may be shaped such that it may enclose at least a side and a perimeter of the device 10. Examples of suitable shapes may be dome-shaped or box-shaped. Further, the cover portion may be elastic at an opening 444 of the cover portion 442 so that the opening 444 may be stretched over the device 10 and stay substantially in place on the device.

The invention claimed is:

1. A lightweight harness system comprising:
an adjuster clip,
the adjuster clip having;
a central aperture,
the central aperture having a securing mechanism,
a cord retention portion,
a length of elastic cordage,
the length of elastic cordage having;
a mid-point,
a first free end having a running portion,
a second free end having a running portion,
at least one accessory fastener,
the mid-point of the elastic cordage attached within the retention portion of
the adjuster clip with the first and second free ends extending away in a first direction,
the at least one accessory fastener movably attached over the first free end,
another the at least on accessory fastener movably attached over the second free end,
the first and second free ends inserted through the central aperture and securing mechanism in a second direction opposite the first direction,
the running portion of the first free end forming a first loop,
the running portion of the second free end forming a second loop, the first and second loops having substantially the same length, and,
the first and second free ends secured together wherein the length of cordage forms a continuous loop.

2. The harness of claim 1 wherein when the first and second free ends are pulled through the securing mechanism, the length of the first loop and the length of the second loop change proportionally to the length of movement with the first and second free ends.

3. The harness of claim 1 wherein the securing mechanism is biased in a locked position.

4. The harness of claim 1 wherein the retention portion including a first and second apertures.

5. The harness of claim 1 wherein the first free end and the second free end are secured together by one of a knot, sewing, a crimp and a mechanical clip.

6. The harness of claim 5 wherein the mechanical clip including a secondary feature such as one of a whistle and a compass.

7. The harness of claim 1 including an accessory cover comprising;
a pouch portion,
a cover portion,
the cover portion attached to the pouch portion,
the cover portion configured to be stuffed into the pouch portion, and,
an attachment portion configured to clip onto the elastic cordage.

8. A method of using a lightweight binocular harness comprising;
providing an adjuster clip,
the adjuster clip having;
a central aperture,
the central aperture having a securing mechanism,
a cord retention portion,
providing a length of elastic cordage,
the length of elastic cordage having;
a mid-point,
a first free end having a running portion,
a second free end having a running portion,
providing at least one accessory fastener,
the mid-point of the elastic cordage attached within the retention portion of
the adjuster clip with the first and second free ends extending away in a first direction,
the at least one accessory fastener movably attached over the first free end,
another the at least on accessory fastener movably attached over the second free end,
the first and second free ends inserted through the central aperture and securing mechanism in a second direction opposite the first direction,
the running portion of the first free end forming a first loop,
the running portion of the second free end from a second loop, and,
the first and second loops having substantially the same length,
the first and second free ends secured together wherein the length of cordage forms a continuous loop,
providing a binoculars having attachment studs,
attaching the at least one accessory fastener to an attachment stud,
attaching the another at least one accessory fastener to an attachment stud,
extending a first arm of a user through the first loop formed within the running portion of the first free end,
the first loop having an upper portion running over a first shoulder of the user and a lower portion around a abdomen,
extending a second arm of the user through the second loop formed within the running portion of the second free end,
the second loop having an upper portion running over a second shoulder of the user and a lower portion around the abdomen,
placing the adjuster clip behind the neck of the user while allowing the binoculars to hang on the chest of the user, and,
adjusting the height of the binoculars by releasing the securing mechanism and moving the free ends of the cordage through the adjuster clip.

9. The method of claim 8 including;
restraining the binoculars by,
stretching the lower portion of the first loop over a first objective lens, and,
stretching the lower portion of the second loop over a second objective lens.

* * * * *